US005700186A

United States Patent [19]

Hykes et al.

[11] Patent Number: 5,700,186

[45] Date of Patent: Dec. 23, 1997

[54] MOTORIZED SPINDLE WITH INDEXING FIXTURE

[75] Inventors: Timothy W. Hykes; Joel Metzler, both of Greencastle, Pa.

[73] Assignee: Western Atlas Inc., Waynesboro, Pa.

[21] Appl. No.: 566,967

[22] Filed: Dec. 4, 1995

[51] Int. Cl.[6] ..... B24B 41/06

[52] U.S. Cl. ..... 451/406; 451/251; 451/399; 451/407

[58] Field of Search ..... 451/246, 249, 451/251, 399, 406, 407, 408

[56] References Cited

U.S. PATENT DOCUMENTS

| | | |
|---|---|---|
| 2,250,632 | 7/1941 | Groene . |
| 2,484,897 | 10/1949 | Hoier et al. . |
| 2,651,895 | 9/1953 | Rocks . |
| 2,733,560 | 2/1956 | Strnad . |
| 2,921,487 | 1/1960 | Schabot . |
| 3,063,265 | 11/1962 | Schmidt . |
| 3,583,108 | 6/1971 | Oishi et al. . |
| 3,584,423 | 6/1971 | Hoare . |
| 3,664,153 | 5/1972 | Sugahara . |
| 3,769,761 | 11/1973 | Ohsima . |
| 3,961,780 | 6/1976 | Saj . |
| 5,189,846 | 3/1993 | Griswold . |

OTHER PUBLICATIONS

Advertising Sheet—"Accuracy in Rotary Motion", A.G. Davis Gage & Engineering Co.

Advertising Sheet—"Need a 4th Axis for Your Coordinate Measuring Machine? Precision Rotary Tables from A.G. Davis", A.G. Davis Gage & Engineering Co.

Advertising Sheet—"Put Teech In Your Indexing With A.G. Davis Circle Divider", A.G. Davis Gage & Engineering Company, Oct. 1989.

*Primary Examiner*—Eileen P. Morgan

*Attorney, Agent, or Firm*—Hoffman, Wasson & Gitler

[57] ABSTRACT

A spindle, comprised of a spindle body and an indexing fixture, is configured to retain, and rotatingly drive, a crankshaft relative to a grinding tool, so that each pin on the crankshaft is ground with a high degree of precision. A locking mechanism, such as a pair of jaws with complementarily shaped teeth, is interposed between the spindle body and the indexing fixture. Pressure is applied to one side of the locking mechanism so that the jaws are normally engaged and the spindle body and the indexing fixture rotate as a unit. Motive power for such fixture is supplied by a single servomotor secured to a primary drive shaft, which is joined to a secondary drive shaft, through an offset coupling, to define a motorized spindle.

The indexing fixture is bolted, or otherwise secured, to the free end of the secondary drive shaft. A bearing block in the indexing fixture receives and retains, the main shaft of the crankshaft; clamping arms with clamp shoes press the shaft downwardly into the bearing block. To place a pin on the crankshaft in position to be ground, pressure is supplied intermediate the jaws of the locking mechanism to force same apart. The secondary drive shaft then rotates the uncoupled indexing fixture relative to the spindle body to place an unground pin in a position to be ground by a grinding tool operatively associated with the motorized spindle.

Keys and keyways are formed between the spindle body and the indexing fixture. A threaded bolt, and the cooperating nut, allow limited movement between such components to adjust the throw for pins located at different elevations along the crankshaft to be ground. A zero angle reference point is established by milling a reference pad on a crank pin web situated between the main bearing shaft and the first pin on the crankshaft.

9 Claims, 11 Drawing Sheets

MOTORIZED SPINDLE WITH INDEXING FIXTURE

FIELD OF THE INVENTION

This invention relates to motorized spindles for driving workpieces, such as crankshafts, and for indexing such workpieces relative to a grinding tool, so that each crank pin on the crank shaft is accurately ground, in sequence.

BACKGROUND OF THE INVENTION

In known grinding machines, such as shown in FIG. 1 of U.S. Pat. No. 5,405,282, granted Apr. 11, 1995 to William W. Pflager, and assigned to the assignee of the instant application, an abrasive grinding wheel (28) is rotatably mounted upon a wheel head (26) for translation relative to a cam shaft (22), that is ground to a desired size and shape. The workpiece is retained between a headstock (18) and a footstock, and the wheel head, with the grinding wheel, is translated by a nut (40) and lead screw (42) arrangement. The unit is secured to the wheel head, and the lead screw is driven by a motor (44), coupled to the end of the lead screw remote from the nut. The motor, which may be numerically controlled, rotates the lead screw relative to the nut, in either clockwise or counterclockwise fashion, and thus linearly translates the abrasive grinding wheel relative to the workpiece. The grinding wheel may be advanced along its axle (30) to grind each lobe in the camshaft, in sequence.

Other grinding machines employ an endless abrasive belt to grind each lobe, or eccentric surface, on a camshaft, in sequence. Recently, grinding machines relying upon several, simultaneously operated, parallel, abrasive grinding belts have been employed, with attendant savings in operating costs and higher output per machine. Representative multiple belt grinders are disclosed in U.S. Pat. No. 5,142,827, granted September 1992 to Phillips and in U.S. Pat. No. 5,359,813, granted Nov. 1, 1994 to R. E. Kaiser, Jr. and Steven G. Lueckeman.

The foregoing grinding machines function satisfactorily for cam shafts, which have a central axis of rotation extending longitudinally through the journals at the opposite ends of the shaft to be ground. One journal is retained in a chuck operatively associated with the head stock, while the other journal is retained in a chuck operatively associated with the tail stock. Drive motors in the head stock and tail stock rotate the cam shaft, relative to the grinding tool, and programs stored in computers that control the drive motors provide the information necessary to grind the cam shafts to the desired configuration.

The cam shafts are angularly aligned relative to the chucks, to establish a fixed reference point for the subsequent grinding operations. The reference point is usually established by cooperation between interengaging mechanical members formed in the journal bearings of the cam shaft and the chucks. The mechanical members might assume the form of a key milled in the journal bearing, and a key way in the chuck, or vice versa. Pins and slots, balls that are spring-loaded into engagement with dimples or locating holes in the journal bearings, etc. have also been utilized.

Whereas cam shaft grinding machines have become better suited to high speed processing, on automated or semi-automated machines, with reductions in the number of skilled technical personnel to operate and oversee same, similar advances have not been realized with crank shaft grinding machines.

Crank shafts, which are formed by iron castings or by forged steel techniques, are considerably heavier and more cumbersome to manipulate than cam shafts. Eccentrics are formed on the crank shaft, inboard of the main bearings, to provide bearing surfaces for the connecting rods of an automotive vehicle. Crank shafts also introduce difficult geometric relationships, for while a first longitudinal axis is drawn between the journals at the opposite ends of the crank shaft, other longitudinal axes are drawn through the center lines of the pins spaced along the crank shaft. The pins to be ground are radially and longitudinally disposed about the first, or central, longitudinal axis, and the longitudinal axes of the pins must be maintained parallel to the first, or central, longitudinal axis. The crank shaft rotates about the pin axis, while the first, or central, longitudinal axis rotates eccentrically about the pin. The grinding tool, which abrades a limited amount of metal from each pin, only establishes contact with the pin to be ground after the pin has been indexed into the appropriate position.

Known crank shaft grinding machines, employ mechanical keys and cooperating holes, and/or similar interengaging mechanical components, to properly align the crank shafts within the chucks in the head stock and foot stock of the grinding machines, and thereby establish a zero reference angle for subsequent grinding operations.

Complicated fixtures were employed to properly position the pin to be ground relative to the grinding tool. The accurate grinding of the crank shaft, within acceptable tolerances was slow, time-consuming, and required highly trained, technically skilled operators.

The difficulties inherent in grinding crank shafts have been compounded recently, when the customers for the ground crank shafts, typically automobile, truck, farm vehicle manufacturers, construction equipment manufacturers, etc., have insisted that the mechanical keys, holes, etc. which are previously used to establish a zero reference angle be eliminated. Consequently, a new and different technique had to be utilized to hold the crank shaft and establish the zero reference angle.

SUMMARY OF THE INVENTION AND ADVANTAGES

The instant invention pertains to a motorized spindle, comprising a spindle body and an indexing fixture. The same motor drives the spindle body and indexing fixture, as a unit, or drives the indexing fixture relative to the spindle body. The motor delivers power directly to a primary drive shaft aligned with the center line of the spindle body, and indirectly to a secondary drive shaft aligned with the center line of the main bearings, or journals, on the opposite ends of a crank shaft.

An off-set coupling efficiently transfers power from the primary drive shaft to the secondary drive shaft, while maintaining the parallel relationship therebetween. The coupling includes parallel links installed 90° out of phase with each other. In a preferred form, such coupling is a Schmidt off-set coupling, cooperating keys and key ways in the interior of the motorized spindle retain the components in alignment.

Furthermore, since the ultimate end-user of the crank shaft requires the journals, and crank pins, to be cylindrical in shape, the journals, and crank pins, of the crank shafts must be maintained in unblemished, cylindrical shape at all times. The key ways, or holes, previously formed on the end of the crank shaft, to facilitate establishment of a zero angle reference point for all grinding operations, are no longer acceptable to the customers for the ground crank shafts.

Consequently, a reference pad is now milled, or otherwise formed, on the crank pin web situated between the journal and the first pin on the crank shaft. A work rest forces such reference pad against a stop to define a zero angle reference point, in conjunction with the upwardly opening bearing block that receives a journal on the crank shaft.

The indexing fixture, which is intermittently advanced, rotates the pin to be ground to a position coincident with the center line of the spindle body. During grinding operations, the spindle body and indexing fixture are retained together by a locking mechanism, and rotate as a unitary mechanism. During indexing operations, the indexing fixture is disengaged from, and adjusted relative to, the spindle body, when the locking mechanismm is released.

The degree of angularity for such rotation, from 0° to 360°, is determined by a circle-divider within the locking mechanism, comprising, inter alia, opposing jaws with cooperating, interengaging teeth spaced at 3° intervals. The opposing jaws are normally urged into meshing, or locking, engagement by the application of pressurized fluid. However, the fluid pressure is relieved, and/or reversed, when necessary, to allow disengagement of, and then relative rotation, between the opposing jaws. The extent of angular adjustment moves the pin to be ground to the desired angular relationship relative to the grinding tool. After such adjustment, the opposing jaws are forced together and the angular relationship of the pin to the grinding tool is maintained during the grinding operation.

The jaws of the circle divider are forced together, to retain the indexing mechanism immobile, by the greatest force employed within the instant machine. Each succeeding locking, or retaining, mechanism found in the motorized spindle operates at a lower force. This step-wise reduction in forces produces a force path to ground effect within the motorized spindle, which tends to keep all components of the indexing fixture and motorized spindle united as a unitary device.

The drive motor for the motorized spindle and indexing fixture is bolted, or otherwise secured, to the rear end of the primary shaft. The primary shaft rotates within a squeeze bushing that surrounds the primary shaft. Pressure is imparted to the squeeze bushing to lock the primary shaft, after the circle-divider is clamped into angular position. The primary shaft, in turn, through the squeeze bushing, drives the spindle body.

When the primary shaft and secondary shaft are driven in unison, through the coupling, the circle divider controls the angular positioning of each crank pin relative to the grinding tool. A threaded bolt and complementary nut provide throw adjustment for the pin relative to the first, or main, bearing axis.

The foregoing motorized spindle may function as a head stock, and a similar motorized spindle may function as a tail stock. The head stock and tail stock are be coupled together, in a master-slave relationship, so that the crank shaft can be accurately ground, in a slip-free manner, within tolerances previously unobtainable under high-speed production conditions.

Yet other advantages of the instant motorized spindle will become readily apparent to the skilled artisan when the appended drawings are construed in harmony with the ensuing description of a preferred embodiment.

BRIEF DESCRIPTION OF THE DRAWINGS

FIG. 8A shows the circle divider within the locking mechanism for the indexing fixture being pressured to force the jaws of such mechanism together, while

FIG. 8C shows the jaws of the circle divider within the locking mechanism for in engaged position, while

DESCRIPTION OF THE PREFERRED EMBODIMENT

Figure 1:
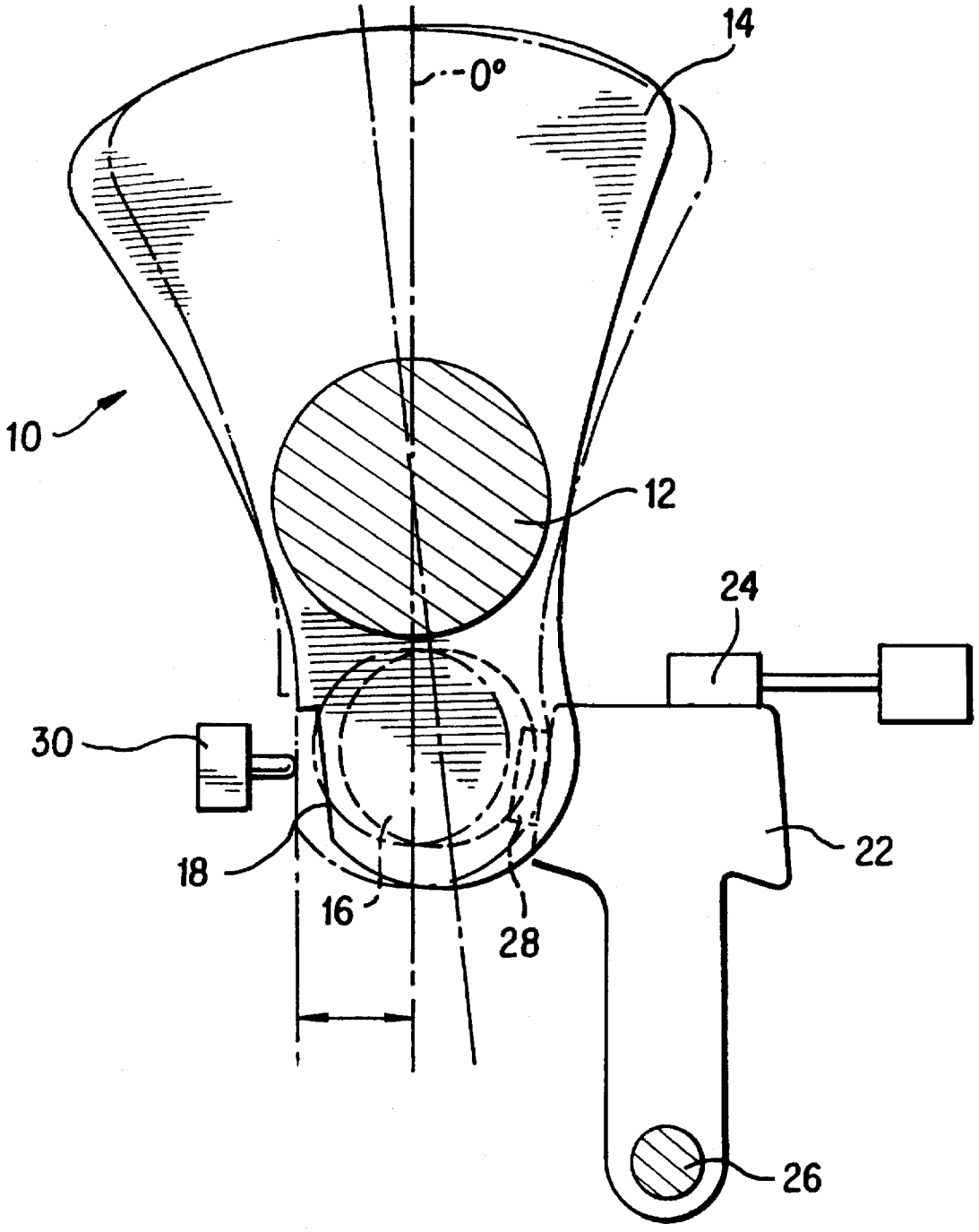
FIG. 1 is an end elevational view of the main bearing shaft of the crank shaft to be ground, such view further showing the mechanism for aligning the main bearing shaft relative to the primary drive shaft of the motorized spindle constructed in accordance with the principles of the present invention.
Figure 4:
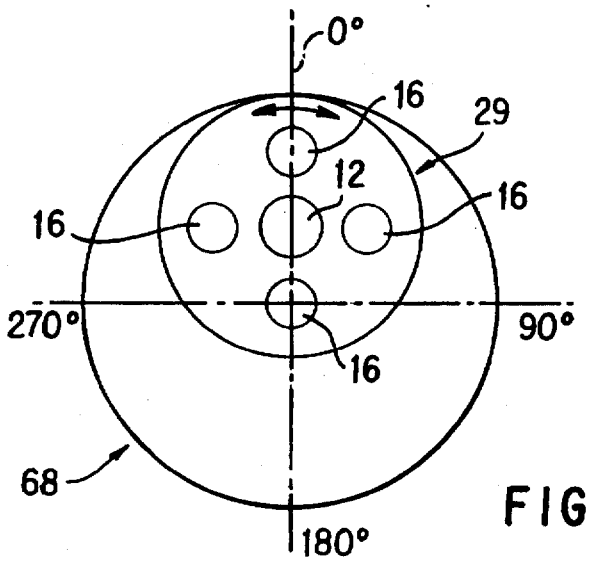
FIG. 4 is a schematic view showing the relationship between the main bearing axis upon which the crank shaft is supported, and the axes of the pins which are coincident with the center line of the primary drive shaft when the pins are in position to be ground.
Figure 5A:
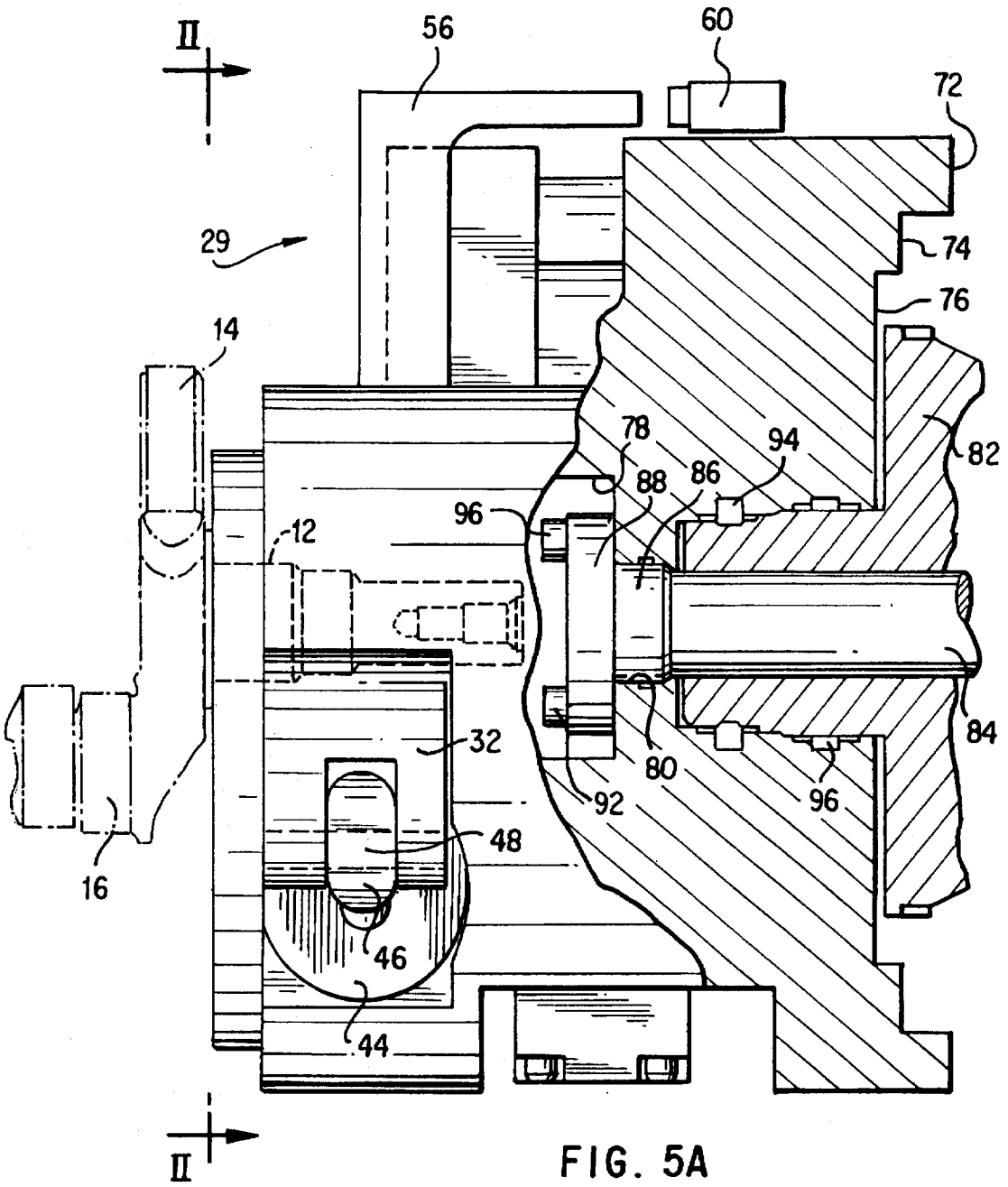
FIG. 5A is a side elevational view, with fragmentary portions removed, of the indexing fixture with the secondary drive shaft secured thereto.
Figure 8A:
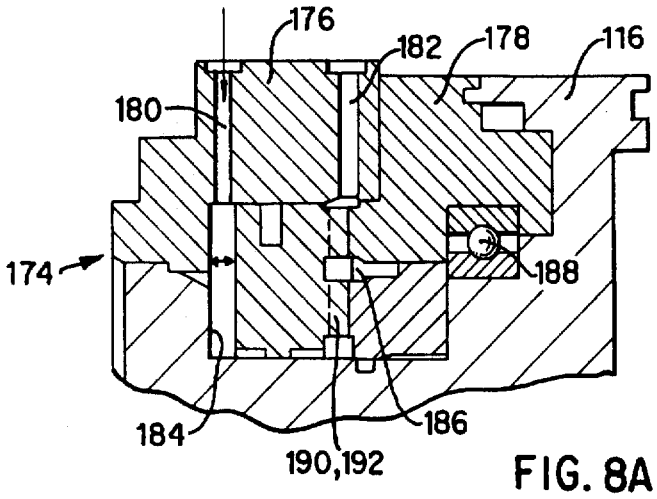
Figure 8B:
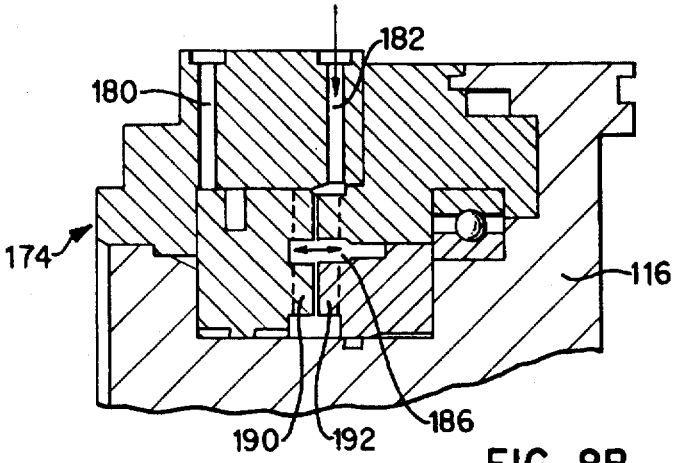
FIG. 8B shows the two halves being forced apart.

FIGS. 1 and 5A show a fragment of a conventional crank shaft, indicated generally by reference numeral 10, that is to be ground by a known abrading tool, such as a grinding wheel. The crank shaft is retained in proper position relative to the grinding wheel by a first motorized spindle, commonly called a head stock, and a second motorized spindle, commonly called a tail stock. The grinding wheel may be indexed relative to crank shaft 10, or vice versa, parallel to the spindle axes, so that the several pins on the crank shaft are ground in serial fashion. Only the first motorized spindle is shown in FIGS. 1–8 for the sake of clarity, but FIG. 9 shows the interrelationship between a pair of motorized spindles.

Crank shaft 10 includes a main bearing shaft 12, crank pin webs 14 located inboard of main bearings 12, and a series of crank pins 16. A reference pad 18 is milled into crank pin web 14 below shaft 12 and adjacent to pin 16, as shown in FIG. 1.

Figure 2:
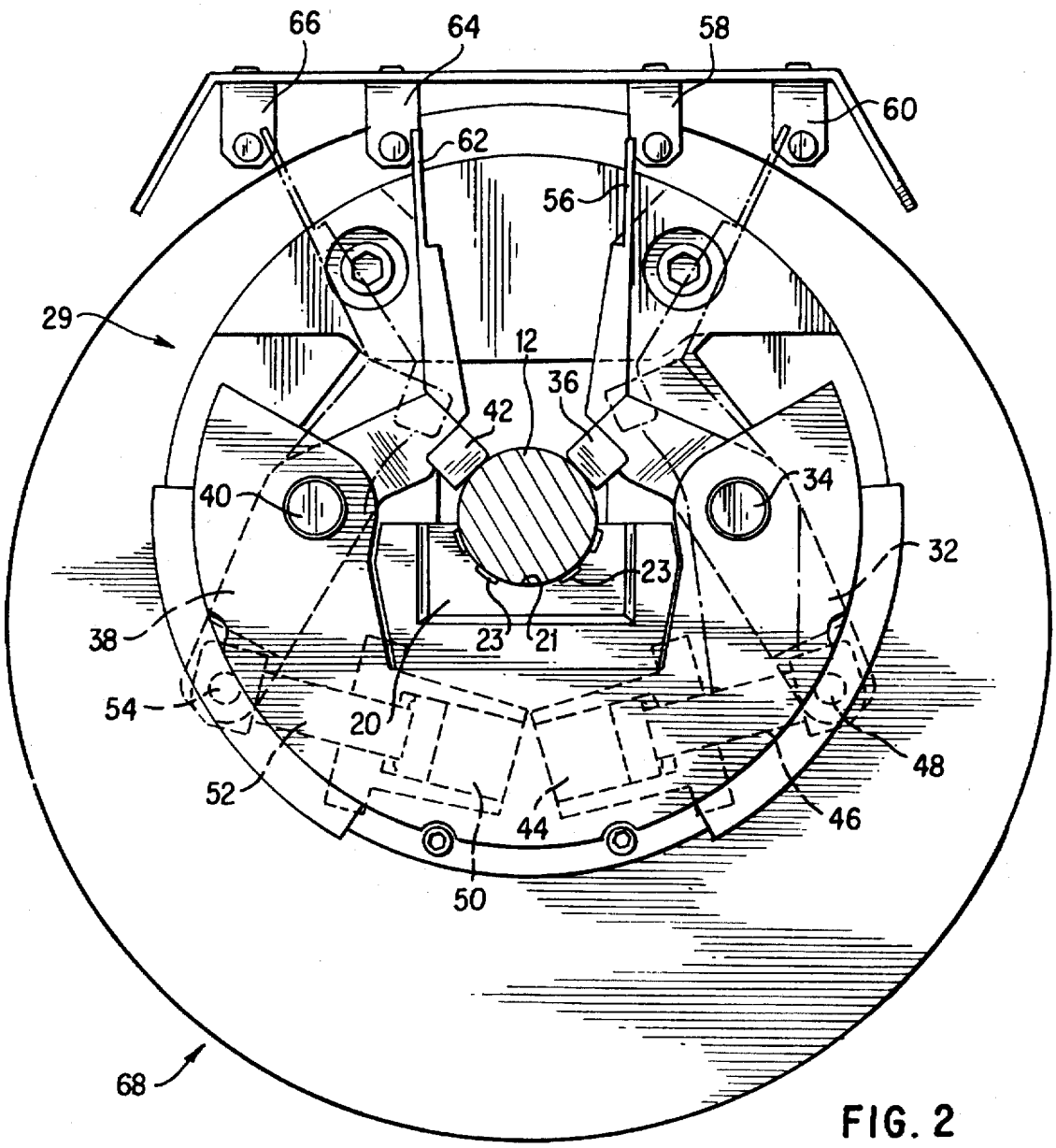
FIG. 2 is an end elevational view of the indexing fixture of the motorized spindle, such view taken along line II—II in FIG. 5A, and showing the clamping mechanism for retaining the main bearing shaft within the cradle.

With the motorized spindles stopped, and the clamps in opened, or non-engaged positions, the main bearing shaft 12 or crank shaft 10 is inserted, via gravity, into bearing block 20, shown in FIGS. 2 and 4. Bearing block 20 has a semi-circular cut-out 21 that accepts bearing shaft 12, and wear resistant bearings 23 are spaced about cut-out 21, so that crankshaft 12 can be located accurately therein.

After shaft 12 is seated with pin 16 resting therebelow, as shown in FIG. 1, work rest 22 is operated toward part 24 so that the work rest pivots about pin 26 and pad 28 presses against pin 16. Crank pin web 14 is thus rotated so that reference pad 18 contacts stop 30, and the axes of rotation for shaft 12 and pin(s) 16, are established along a common center line, as shown in FIG. 1. The extent of movement of pin 16 is ascertained by comparing the solid outline of crank pin web 14 with the dotted outline of crank pin web 14 in FIG. 1.

FIG. 2 shows an indexing fixture, indicated generally by reference numeral 29. Indexing fixture 29 includes a first clamping arm 32 that is pivoted about its axis 34 so that clamp shoe 36 presses against shaft 12. Second clamping arm 38 is pivoted about its axis 40 so that clamp shoe 42 presses against shaft 12. Clamp arms 32, 38 operate simultaneously. Bearing block 20, bearings 23, and clamp shoes 36, 42 retain shaft 12 securely seated within cut-out 21 to maintain shaft location within the indexing fixture.

Hydraulic cylinder 44, when pressurized, extends piston 46 which is secured by pin 48 to the lower end of first arm 32. Similarly, hydraulic cylinder 50, when pressurized, extends piston 52 which is secured by pin 54 to the lower end of second arm 38. Clamping arms 32, 38 are shown, in dotted outline, in the "opened" position, which allows free ingress of the crank shaft 10, including main bearing shaft 12, into bearing block 20. After main bearing shaft 12 is seated, then the clamping arms are pressurized, through cylinders 44 and 50, to "closed" position, wherein clamp shoes 36, 42 press downwardly upon shaft 12.

Blade 56 projects upwardly from the free end of clamping arm 32, and switches 58, 60 respond to the movement of blade 56 to detect whether the clamping arms are opened, or closed. In a similar fashion, blade 62 projects upwardly from the free end of clamping arm 38, and switches 64, 66 respond to the movement of blade 62.

The size relationship and the unique spatial relationship, between indexing fixture 29, and the main spindle body, indicated generally by reference numeral 68, is also shown in FIG. 2. Indexing fixture 29 is mounted upon the forward end of main spindle body 68, and is operatively associated therewith. Indexing fixture 29, and main spindle body 68, and their constituent parts, form a motorized spindle.

Figure 3:
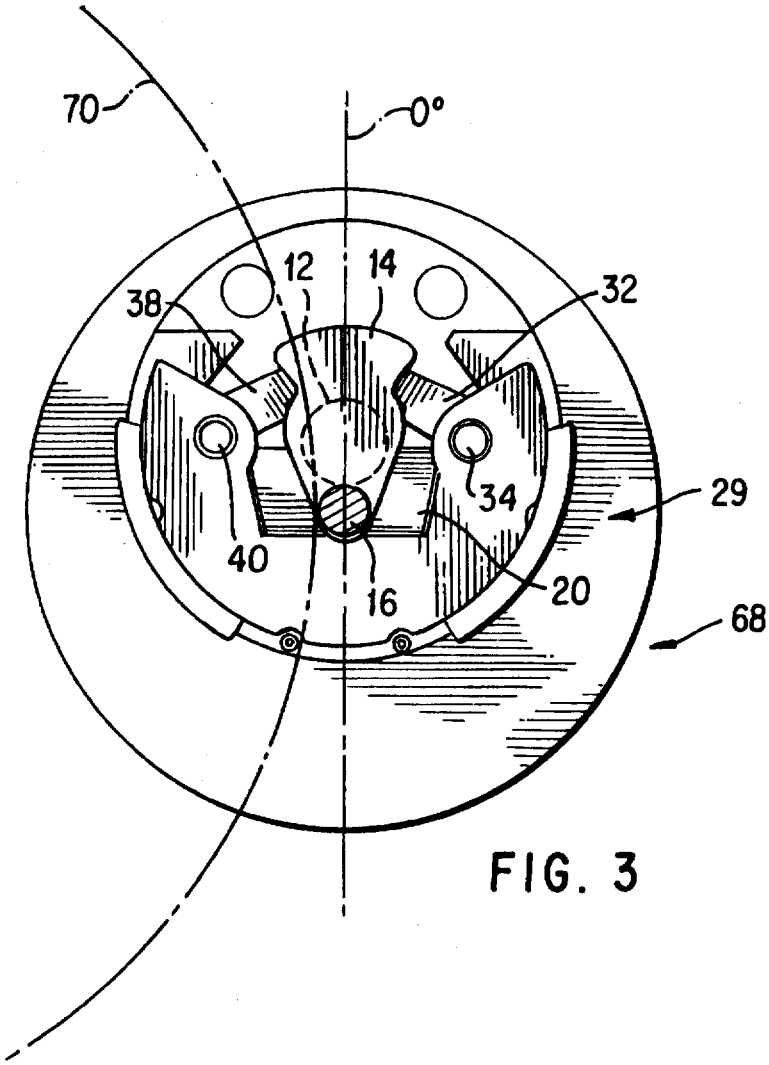
FIG. 3 is an end elevational view of the indexing fixture with the main bearing shaft in the cradle and the pin to be ground positioned therebelow so that the grinding tool can contact and grind same.

FIG. 3 depicts the spatial relationships achieved by the instant motorized spindle that are essential to its successful operation. The common center line extending through main bearing shaft 12 and pin 16, depending therebelow, establishes a zero angle reference point for all subsequent grinding operations effectuated on crank shaft 10. Main bearing shaft 12 is seated in cut-out 21 in bearing block 20, and clamping arms 32, 38 retain the shaft securely seated in the bearing block. The depending pin 16 is coincident with the primary drive shaft (not shown) in main spindle body 68, while main bearing shaft 12 is coincident with the secondary drive shaft (not shown) in indexing fixture 29. Indexing fixture 29 is indexed by the secondary drive shaft, about main bearing shaft 12, and main spindle body 68, to place the pin 16 to be ground in a position below main bearing shaft 12 and tangential to rotary grinding wheel 70. The pins on crank shaft 10 are ground, seriatim, by grinding wheel 70 as each pin is indexed to the position shown in FIG. 3, and longitudinally advanced, relative to grinding wheel 70, shown in phantom outline.

FIG. 4 indicates that pins 16 are angularly distributed about the main bearing shaft 12 of crank shaft 10 at a common radial distance. Indexing fixture 29 is indexed to position the pin 16 to be ground at a position coincident with the primary drive shaft (not shown) and/or center line of main spindle body 68. Indexing fixture 29 and main spindle body 68 usually rotate in a unitary fashion, when power is supplied to the motorized spindle. However, when indexing fixture 29 is indexed to advance the pin 16 to be ground at the requisite position, indexing fixture 29 is disengaged from main spindle body 68 and is driven relative thereto. The mechanisms for implementing this novel method of operation are shown in FIGS. 5–9, discussed hereinafter.

FIG. 5A shows the indexing fixture 29 in side elevation, with a fragment broken away to show the connection between indexing fixture 29 and main spindle body 68. Steps 72, 74 and 76 are defined in the rear face of indexing fixture 29, and a central chamber 78 is defined in the interior of the fixture. An axial bore 80 extends from the stepped rear surface of the fixture into the central chamber 78.

Forwardly extending nose 82 on index spindle body 116 fits into axial bore 80, and secondary drive shaft 84 extends through the nose and is secured to indexing fixture 29. Bolts 92, 93 extend through secondary drive shaft flange 88 and into indexing fixture 29 in the vicinity of chamber 78. Secondary shaft 84 is thus secured to indexing fixture 29 to deliver driving forces thereto. Seals 94, 96 are interposed between nose 82 and bore 80; the seals are used to connect a hydraulic circuit (not shown) from the main spindle hose to indexing fixture 29.

Figure 5B:
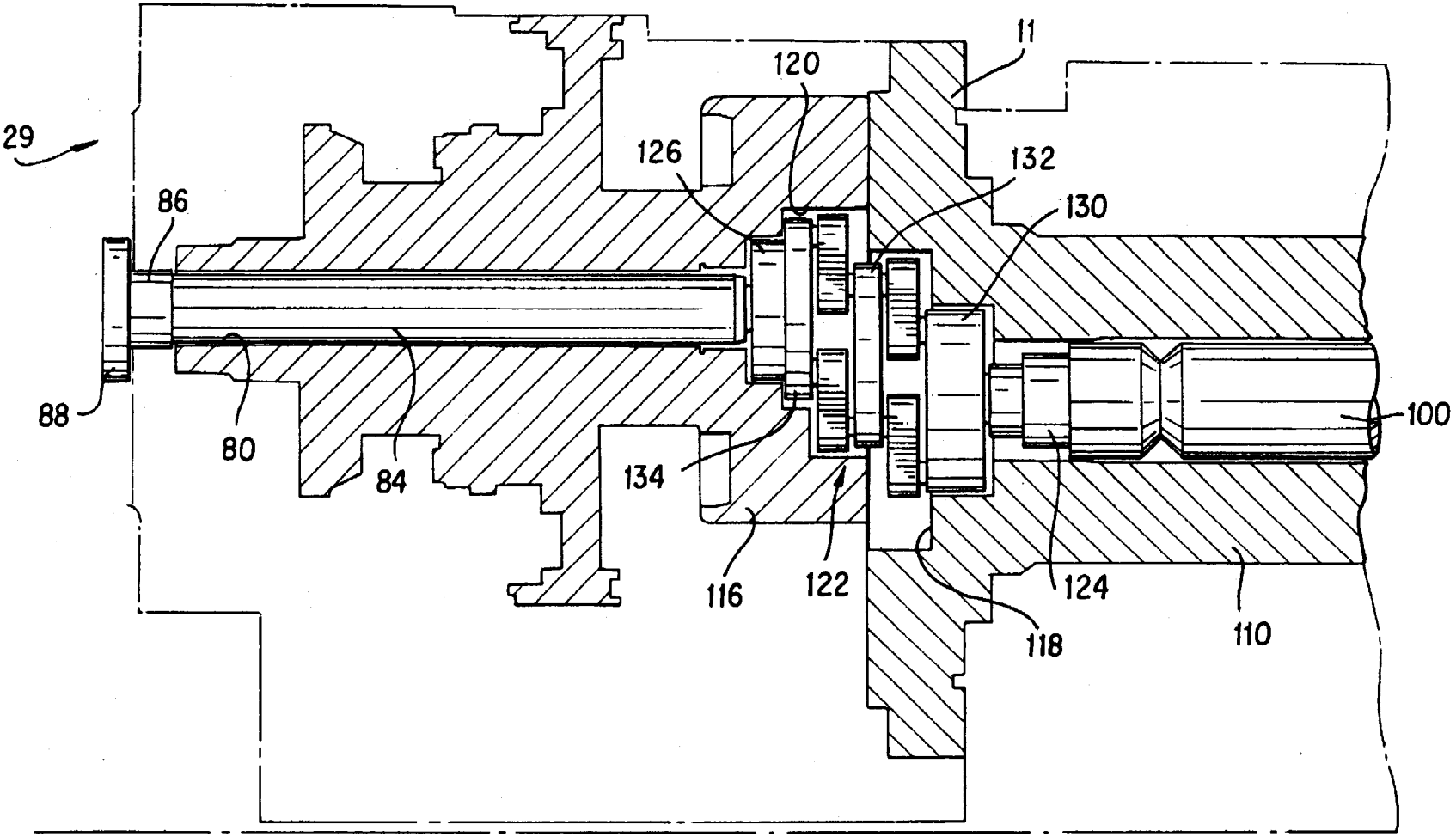
FIG. 5B and FIG. 5C are complementary cross-sectional views of the indexing fixture and the spindle body showing the primary drive shaft, the secondary drive shaft, and the coupling therebetween.
Figure 5C:
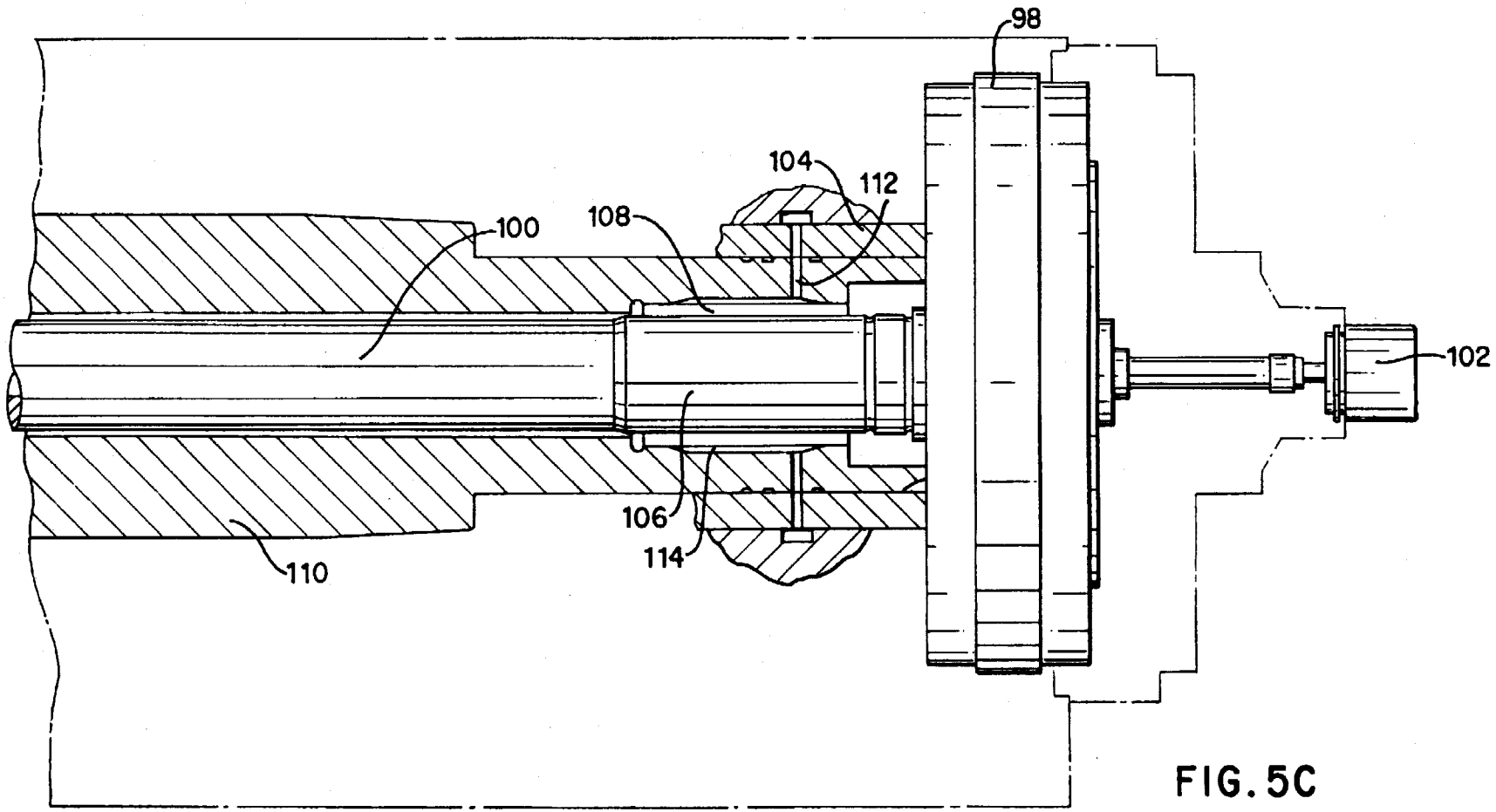
Figure 6A:
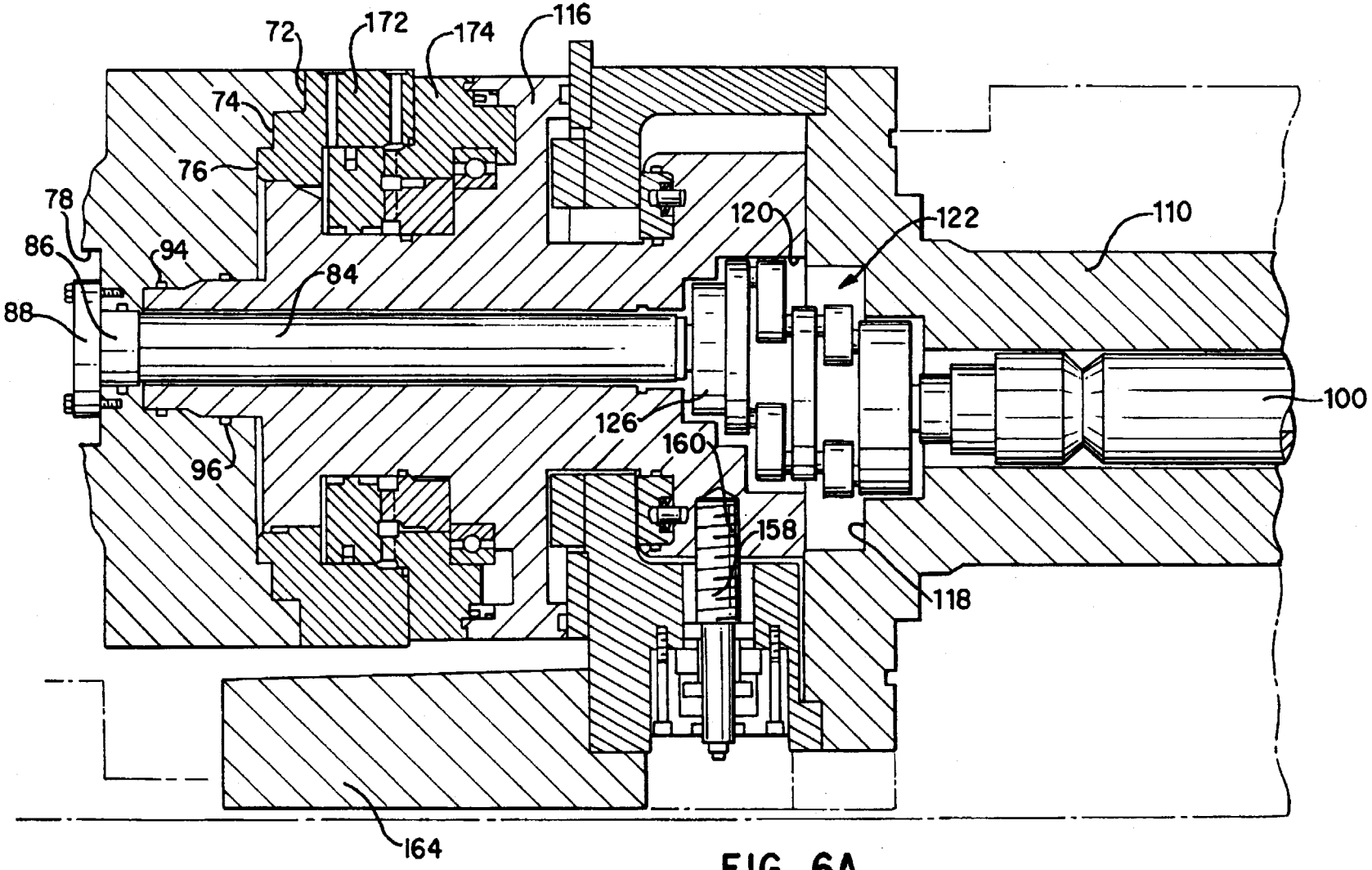
FIG. 6 is an exploded perspective view of the coupling that joins the primary drive shaft to the secondary drive shaft.
Figure 6B:
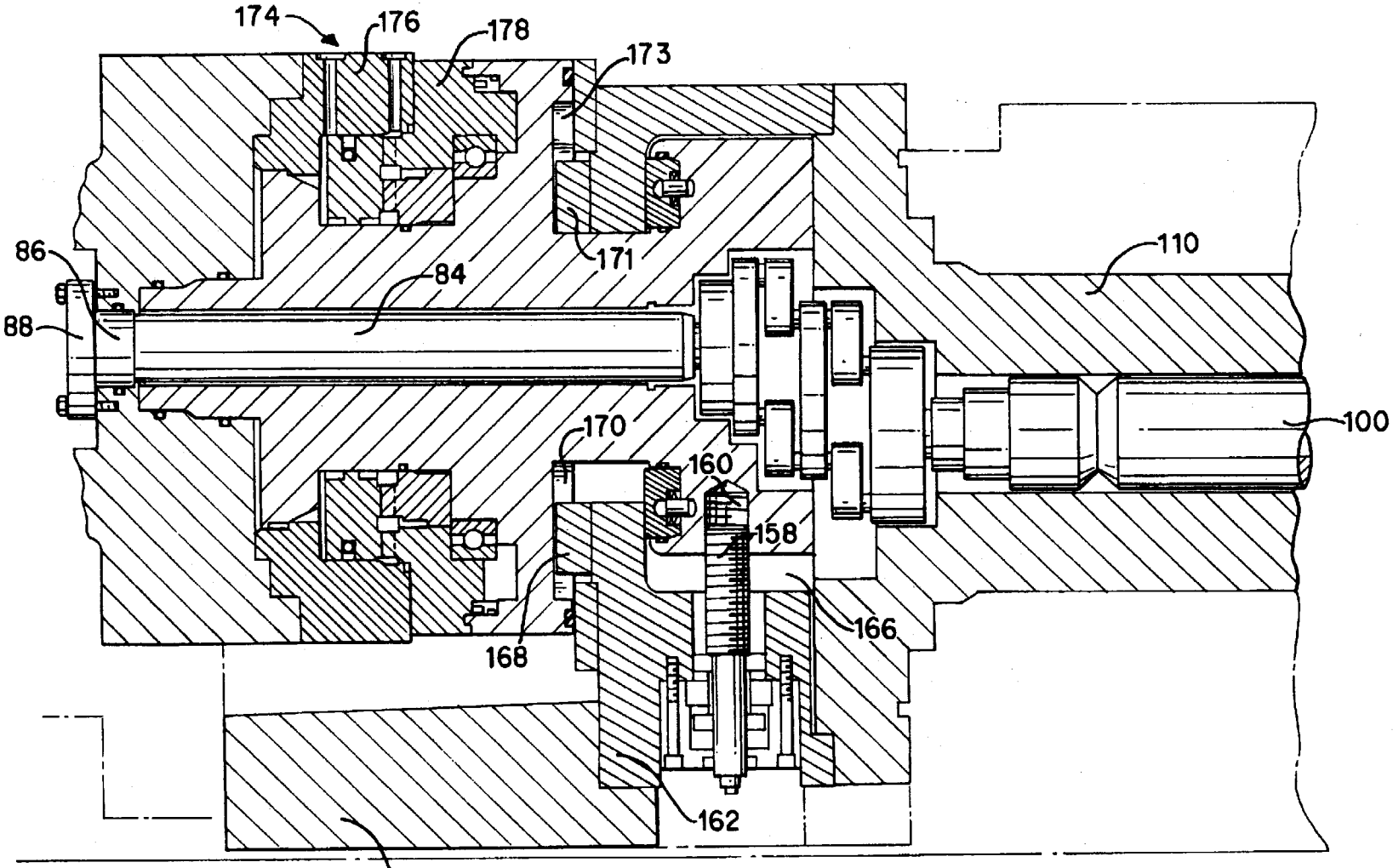
Figure 7:
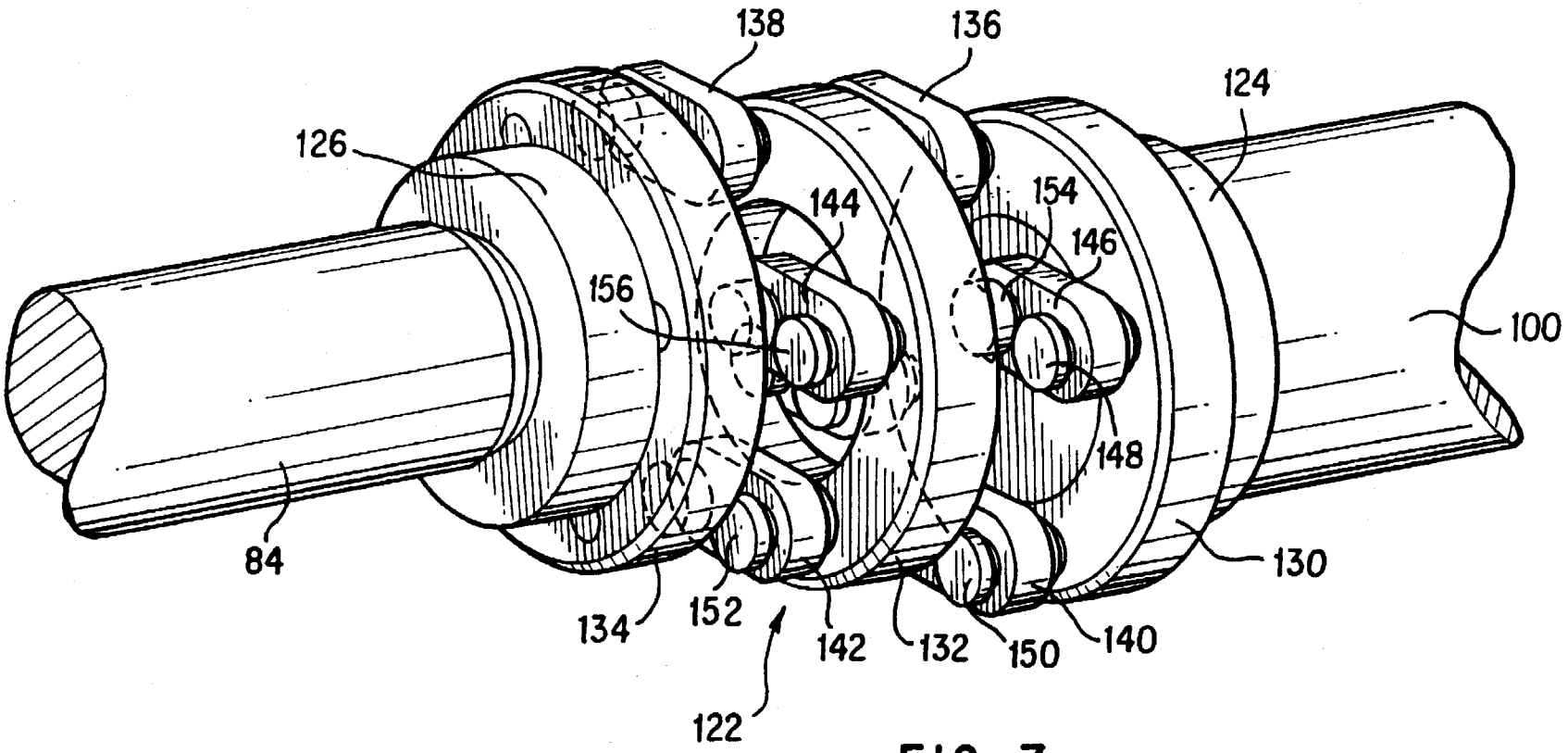
FIGS. 7A and 7B show the stroke adjustment mechanism for shifting the indexing fixture relative to the spindle body.

FIGS. 5B and 5C are drawn on a smaller scale than FIG. 5A, and show main spindle body 68 with indexing fixture 29 removed therefrom, for the sake of clarity. Counterweights are also removed from view in FIGS. 5B and 5C so that attention can be focused upon main spindle body 68.

Viewing FIGS. 5B and 5C together, and starting from the rear of main spindle body 68, the body includes a servomotor 98, such as a brushless thirty-two pole motor, that rotates primary drive shaft 100. The primary drive shaft 100 is located on the center line of main spindle body 68, and is aligned longitudinally with the axes of crank pins 16 on crank shaft 10. An encoder 102 is operatively associated with servomotor 98 to regulate the rotational speed, and/or identify the angular position, of shaft 100.

A hydraulic pick-up.104 encircles the rear segment of main spindle 110. A squeeze bushing 108, which assumes the form of a cylinder with longitudinally extending, deformable fingers, slips over primary shaft 100 so that primary shaft 100 rotates within busing 108. Shaft 100 extends through bearings 106 in main spindle 110, and the associated components, in a rigid, sag free manner. A channel 112 extends radially through hydraulic pick-up 104, and main spindle 110 to communicate with chamber 114, which surrounds squeeze bushing 108. When fluid pressure is introduced into channel 112 and flows into chamber 114, bushing 108 engages primary shaft 100 and retains same in fixed, immobile position. The other components of the index mechanism that are connected to main spindle 110, either directly or indirectly, are also retained motionless.

Main spindle 110 terminates in enlarged flange 111, which abuts against index spindle 116, over an extended surface. Index spindle 116 and flange 111 may be keyed, or otherwise joined together, so that the spindle rotates as a unit. A stepped, outwardly opening, cavity 118 is defined at the forward end of flange 111 of main spindle 110, and a stepped cavity 120 is formed in the abutting portion of index spindle 116. Secondary drive shaft 84 extends through bore 80 in index spindle 116, and flange 88 is bolted to indexing fixture 29; only the outline of a portion of indexing fixture 29 is shown in FIG. 5B. Secondary drive shaft 84 is parallel to, but spaced from, primary drive shaft 100, and an off-set coupling, indicated generally by reference numeral 122, fits into cavities 118, 120 in spindles 110, 116, and effectively transfers power from shaft 100 to shaft 84 in an efficient, slip-free manner.

Off-set coupling 122 may assume different forms, but a preferred coupling, that has functioned effectively under test conditions, is manufactured, and distributed by, ZERO-MAX Company of Minneapolis, Minn. As shown in greater detail in FIG. 6, coupling 122 includes an inlet adapter 124 that is secured to primary drive shaft 100, and an outlet adapter 126 that is secured to secondary drive shaft 84. Discs 130, 132 and 134 have central apertures, and are located parallel to each other, and perpendicular to primary drive shaft 100 and secondary drive shaft 84. Several pairs of parallel links 136, 138; 140, 142; 144, 146; are spaced about discs 130, 132, 134, and pins 148, 150, 152, 154, 156, etc., pass through the links and secure the links between adjacent discs. In a preferred embodiment, four pairs of parallel links are used, spaced 90° apart, to provide for precise transmission of torque and velocity between the shafts.

FIG. 7A shows further details of main spindle body 68, particularly in the vicinity of cavities 118, 120 defined in the abutting surfaces of flange 111 of main spindle 110 and index spindle 116. Pins 16 on crank shaft 10 may be adjusted radially, at different distances from main bearing shaft 12, for different crankshafts. In order to adjust the position of the crank shaft 10 relative to the center line of main spindle 110, a threaded bolt 158 is advanced, or retracted, relative to threaded aperture 160, which extends into index spindle 116. A carrier 162 supports bolt 158.

Index spindle 116 is moved relative to main spindle 110, and a clearance 166 is visible in FIG. 7B. The stepped cavities 118, 120 overlap somewhat, so that coupling 122 is unaffected by the relative movement. Key 168 on carrier 162 rides along key way 170 to facilitate accurate alignment, and key 171 rides along key way 173.

FIGS. 7A and 7B illustrate the circle divider mechanism 174 located at the interface of index spindle 116 and indexing fixture 29. Mechanism 174 includes a first annular support 176, with a stepped profile, which abuts steps 72, 74, 76 of indexing fixture 29, and is secured thereto. A second annular support 178, with a complementary configuration, is retained within index spindle FIGS. 8A and 8B illustrate the circle divider mechanism 174 on a larger scale. Channels 180, 182 are drilled through support 176; channel 180 communicates with chamber 184, while channel 182 communicates with passage 186. Ball bearings 188 allow supports 176, 178 to rotate easily.

Figure 8C:
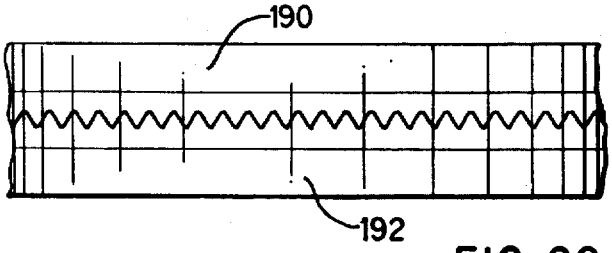
Figure 8D:
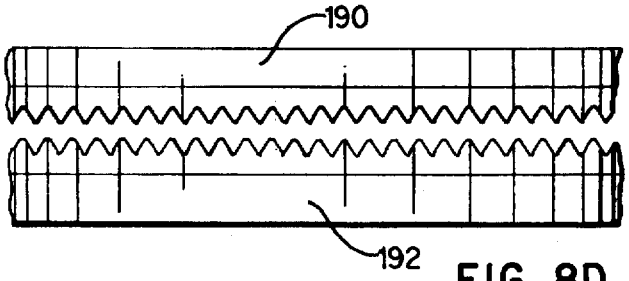
FIG. 8D shows the two jaws in disengaged position.
Figure 9:
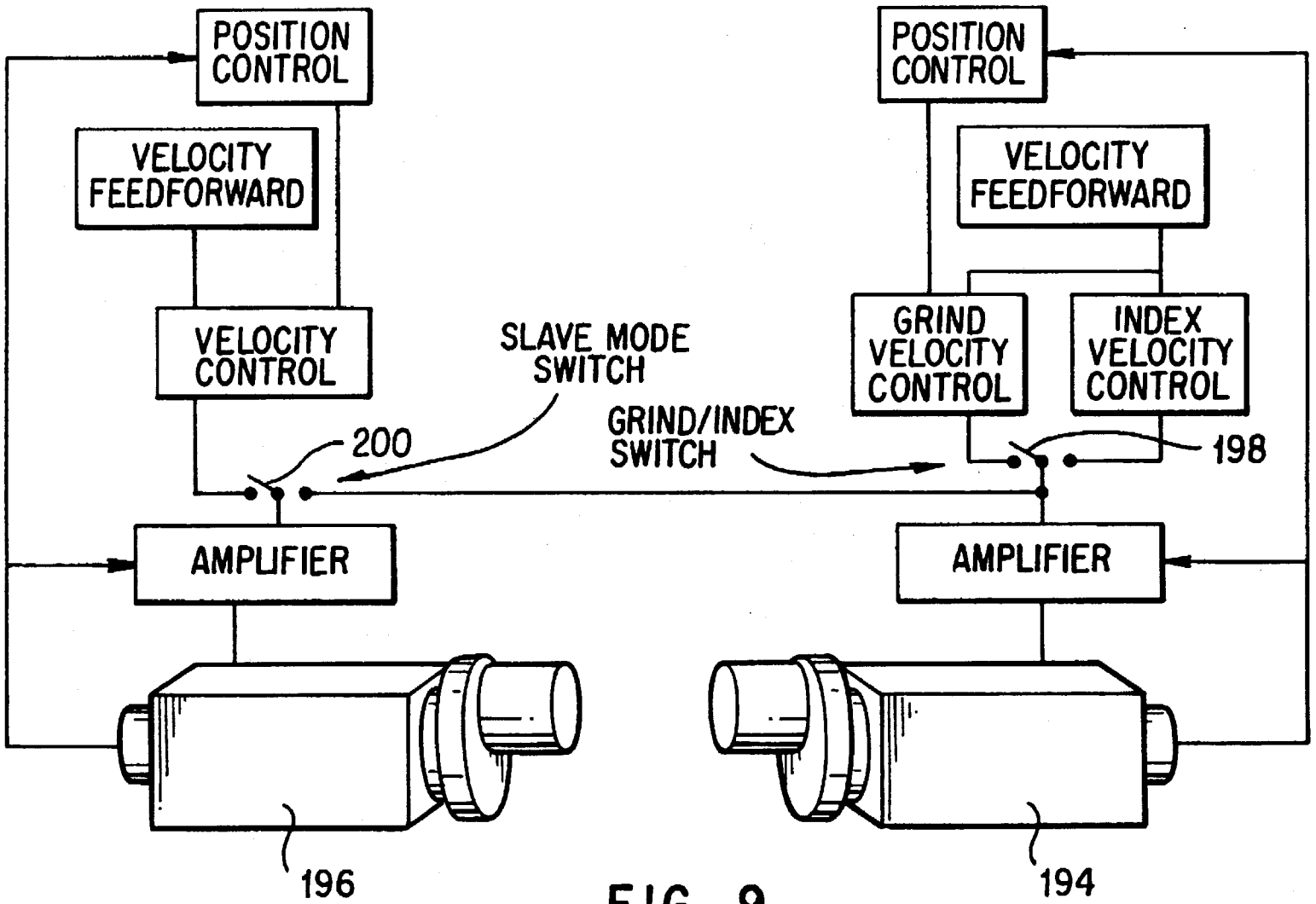
FIG. 9 is a schematic representation of the control circuitry for coordinating the operation of the pair of motorized spindles that align, index, and rotate the crank shaft while grinding operations are performed thereon.

FIGS. 8C and 8D show the two jaws 190, 192 of a circle divider mechanism. Each jaw 190, 192 has triangular, or saw-tooth teeth, that engage with complementary surfaces on the mating jaw. The circle divider mechanism is also known as a Hirth coupling.

The operation of circle divider mechanism 174 can be gleaned from FIGS. 8A–8D. In FIG. 8A, pressure is normally supplied through channel 180 to chamber 184, so that jaws 190 are forced together, and indexing fixture 29 and index spindle 116 rotate together in response to the torque, delivered by shafts 100, 84 through coupling 122. The fixture and index spindle are normally retained in locking engagement, and rotate as a unitary motorized spindle. Circle-divider mechanisms can be purchased from A. G. Davis Gage and Engineering Co. of Hazel Park, Mich.

Intermittently, after the grinding of a pin 16 on the crank shaft 10 has been completed, the need arises to index another pin to be ground to the position shown in FIG. 3. Throw adjust housing 69 and main spindle 110 are then held stationery, by an external latch mechanism (not shown). Pressure is no longer supplied to channel 180 in support 176, as is usual, and as indicated by the directional arrows in FIG. 8A. In lieu thereof, pressure is supplied to channel 182, and passage 186, to disengage jaws 190, 192, as shown by the directional arrows in FIG. 8B, and as suggested by the spacing between the disengaged jaws 190, 192 in FIG. 8D.

While the jaws are disengaged, and indexing fixture 29 is freed from index spindle 116, torque is supplied to indexing fixture 29 via primary drive shaft 100, coupling 122, and secondary drive shaft 84. Flange 88 thus delivers a rotational force to indexing fixture 29 of sufficient magnitude to index a fresh crank pin 16 to be ground into a position below main bearing shaft 12 and coincident with main spindle 110.

After indexing fixture 29 has been rotated, pressure is shut off in channel 182, also. Pressure is re-introduced into channel 180, and chamber 184, to force jaws 190, 192 together. Next pressure is returned to chamber 114, through passage 112, clamping squeeze bushing 108 to primary drive shaft 100. The engagement of jaws 190, 192 couples indexing fixture 29 to index spindle 116, and the external latch mechanism previously coupled to throw adjust housing 69 and main spindle 110, is released and the coupled assemblies rotate as a unitary motorized spindle. Servomotor 98 drives the motorized spindle, when the assemblies are coupled and rotate in unitary fashion, and also furnishes the torque to rotate the indexing fixture, in an intermittent fashion.

FIG. 9 suggests that the motorized spindle constructed in accordance with the principles of the invention can function as a head stock 194, or can function as a tail stock 196. The head stock 194 and tail stock 196 can be coupled together, via grind/index switch 198, slave mode switch 200, and the related circuitry for controlling the head stock and tail stock.

Other modifications, revisions, and refinements will occur to the skilled artisan. Consequently, the appended claims should be construed in a manner consistent with the significant advantages in crank shaft grinding, realized by the instant invention. Thus, the claims should be construed liberally, and should not be restricted to their literal, exact terminology.

I claim:

1. A motorized spindle for rotatively driving and indexing a workpiece with spaced bearing shafts at opposite ends, relative to a grinding tool, said motorized spindle comprising:

a) a spindle body including:

1) a primary drive shaft extending longitudinally along a first axis through the center line of said body, 2) a secondary drive shaft extending longitudinally through said body along a second axis, said secondary drive shaft being located parallel to, and offset from, said primary drive shaft, 3) a motor secured to said primary drive shaft to rotatatively drive said shaft, 4) coupling means for connecting said primary drive shaft to said secondary drive for delivering torque from said motor, b) an indexing fixture including:

1) means for securing said indexing fixture to said secondary drive shaft, 2) clamping means adapted to receive the workpiece, and retain same in operative position relative to said grinding tool, c) locking means interposed between said spindle body and indexing fixture, and d) means for biasing said locking means into an engaged position so that said spindle body and said indexing fixture are driven in a unitary manner, by said motor through said primary and secondary drive shafts and said coupling means.

2. A motorized spindle as defined in claim 1 wherein said primary drive shaft is located along the center line of said spindle body, and said secondary drive shaft is located parallel to, and offset from, said primary drive shaft.

3. A motorized spindle as defined in claim 2 wherein said off-set locking includes a plurality of spaced parallel discs with pairs of links disposed between adjacent discs.

4. A motorized spindle as defined in claim 3 wherein said locking means comprises a pair of opposing jaws, said jaws halves containing teeth of complementary shape.

5. A motorized spindle as defined in claim 4 wherein said means for biasing said coupling means is a first pressure source, of lesser magnitude that acts upon one side of said coupling means to force said jaws together.

6. A motorized spindle as defined in claim 5 further including a second pressure source that introduces pressure between said jaws to force same apart and disengage said indexing fixture from said spindle body.

7. A motorized spindle as defined in claim 1 wherein said clamping means includes a bearing block with an upwardly opening arcuate cut-out to receive a bearing shaft on the workpiece, and clamping fingers to press downwardly upon the shaft to retain same within said bearing block.

8. A motorized spindle as defined in claim 7 wherein clamp shoes are secured to each of said clamping fingers to contact the shaft and press same downwardly into said bearing block.

9. A motorized spindle as defined in claim 1 wherein cooperating keys and keyways are defined between said indexing fixture and said spindle body, and a threaded bolt and cooperating nut adjust said indexing fixture relative to said spindle body to provide an adjustable throw for grinding surfaces at different elevations along said crankshaft.

* * * * *

UNITED STATES PATENT AND TRADEMARK OFFICE

CERTIFICATE OF CORRECTION

PATENT NO. : 5,700,186
DATED : December 23, 1997
INVENTOR(S) : Timothy W. Hykes et al It is certified that error appears in the above-indentified patent and that said Letters Patent is hereby corrected as shown below:

Claim 4, line 3, delete "halves".

Claim 7, line 5, after "shaft", insert --of the workpiece--.

Claim 8, line 3, after "shaft", insert --of the workpiece--.

Claim 9, line 6, change "said crankshaft" to --the workpiece--.

Signed and Sealed this

Twenty-first Day of April, 1998

Bruce Lehman

*Attest:*

BRUCE LEHMAN

*Attesting Officer*

*Commissioner of Patents and Trademarks*